United States Patent [19]

Divall et al.

[11] Patent Number: 5,052,591

[45] Date of Patent: Oct. 1, 1991

[54] DOSING SYSTEM

[75] Inventors: John E. Divall, Grove; John A. Perigo, Witney, both of England

[73] Assignee: Odin Development Ltd., Stevenage, Great Britain

[21] Appl. No.: 159,243

[22] Filed: Feb. 23, 1988

[30] Foreign Application Priority Data

Feb. 24, 1987 [GB] United Kingdom ..... 8704343

[51] Int. Cl.[5] ..... B67D 5/52

[52] U.S. Cl. ..... 222/135; 222/145; 222/148; 222/189; 222/380; 222/559; 222/571; 137/625.48

[58] Field of Search ..... 222/145, 133, 129.2, 222/129.4, 189, 380, 559, 333, 334, 566, 571, 148; 137/874, 872, 885, 625.68, 625.67, 268, 625.48

[56] References Cited

U.S. PATENT DOCUMENTS

| | | | |
|---|---|---|---|
| 2,303,913 | 12/1942 | Collinge et al. | 222/332 X |
| 2,850,990 | 9/1958 | Rasmusson | 222/333 X |
| 3,221,948 | 12/1965 | Kalist | 222/334 |
| 3,643,688 | 2/1972 | Meinert | 222/145 X |
| 3,865,281 | 2/1975 | Byrd et al. | 222/252 |
| 4,119,126 | 10/1978 | Nabiullin et al. | 222/135 X |
| 4,178,929 | 12/1979 | Voegele | 222/152 X |
| 4,271,989 | 6/1981 | O'Neill et al. | 222/333 X |
| 4,371,101 | 2/1983 | Cane et al. | 222/189 X |
| 4,397,407 | 8/1983 | Skoupi et al. | 222/145 X |
| 4,410,108 | 10/1983 | Minard | 272/571 X |
| 4,479,758 | 10/1984 | Hersom et al. | 222/145 X |
| 4,630,972 | 12/1986 | Kinnan | 222/334 X |
| 4,643,228 | 2/1987 | Spencer | 137/625.68 X |
| 4,676,279 | 6/1987 | von Lersner | 222/148 X |
| 4,699,297 | 10/1987 | Raque et al. | 222/148 |
| 4,823,992 | 4/1989 | Fiorentini | 222/333 |

FOREIGN PATENT DOCUMENTS

| | | | |
|---|---|---|---|
| 3506135 | 8/1986 | Fed. Rep. of Germany | 222/135 |
| 2192859 | 1/1988 | United Kingdom | 222/571 |

*Primary Examiner*—Robert P. Olszewski
*Assistant Examiner*—Boris Milef
*Attorney, Agent, or Firm*—Pravel, Gambrell, Hewitt, Kimball & Krieger

[57] ABSTRACT

A dosing system for filling containers with a particulate/liquid mixture includes three piston-and-cylinder devices, of which a first device delivers the mixture downwards to containers advanced beneath it, a second device feeds a thick particulate/liquid mixture via a conduit to the first device, and the third device feeds a thin liquid via a conduit to the first device. A liquid supply port is disposed peripherally in the cylinder of the first device and is swept by the piston thereof, and a conduit in continuous communication with the port extends through the piston to a lower axial end of the piston.

4 Claims, 8 Drawing Sheets

DOSING SYSTEM

BACKGROUND OF THE INVENTION

1. Field of the Invention

This invention relates to a dosing system, especially for filling containers with a particulate/liquid mixture.

2. Description of the Prior Art

GB 2089440 A discloses a pump for metering two fluids, particularly a relatively thick fluid, such as a suspension of solid particles in a liquid, with an homogeneous liquid. The pump comprises a first cylinder containing a floating, solid, first piston and having an inlet conduit and an outlet conduit, a second piston in a second cylinder and for closing the communication between the first cylinder and its inlet conduit and between the first cylinder and its outlet conduit, alternately, the first piston drawing in the thick fluid from the inlet conduit and discharging it into the outlet conduit, and a third cylinder having a piston for drawing in the thin fluid from a second inlet conduit which piston has at least one port provided with one or more valves through which the thin fluid can flow to occupy the space between the first and third pistons where it can transmit the motion of the third piston to the first piston, and a by-pass for conveying thin fluid from the space between the pistons to the outlet conduit.

The bypass serves to feed thin fluid to inwardly directed nozzles in the lower end of the outlet conduit to inject thin fluid into the discharge section to wash away traces of the thick fluid from the lower end of the second piston and from the internal surface of the discharge section, which converges downwardly from just above the level of the nozzles. This arrangement has a number of disadvantages. Firstly, the provision of internal surface portions below the level of the lower end of the stroke of the second piston encourages dripping from the outflow mouth of the outlet conduit. Secondly, the liquid jets may be unsuccessful in preventing an accumulation of sticky substances upon the piston end surface and those internal surface portions. Thirdly, the nozzles may become clogged with particulates and are then awkward to clean.

SUMMARY OF THE INVENTION

According to one aspect of the present invention, there is provided dosing apparatus comprising a piston-and-cylinder device, a peripheral port of the cylinder and swept by the piston as the piston moves between an open position in which an axial end of said piston faces towards said port, and a closed position, drive means for reciprocating the piston in the cylinder, and means for supplying a flowable material to said port, wherein the improvement comprises a conduit extending in said piston and debouching longitudinally of said cylinder at said axial end in the form of a mouth, and means for supplying a liquid to said conduit.

Thus, the dosing apparatus has a simple arrangement whereby flowable material is cleaned away from said axial end and the internal wall of said cylinder by said liquid.

It is advantageous if the conduit mouth at said axial end is of a width almost equal to the internal width of the cylinder, so allowing the liquid to act cleansingly over the internal cross-section of the cylinder. It is also advantageous to provide on said mouth a cover formed with through holes distributed over its area, in order to spread the liquid more regularly over the internal cross-sectional area of the cylinder and to deter entry of the flowable material into the mouth. These holes are preferably small enough that surface tension in the liquid prevents liquid from dripping from the mouth under gravity.

According to another aspect of the present invention, there is provided dosing apparatus comprising a piston-and-cylinder device, a first peripheral port of the cylinder and swept by the piston as the piston moves between an open position in which an axial end of said piston faces towards said port and a closed position, means for supplying a flowable material to said port, drive means for reciprocating the piston in the cylinder, a second peripheral port of said cylinder situated after the first port in the direction from said closed position to said open position for supplying to said cylinder a liquid, wherein the improvement comprises the arrangement being such that the reciprocation of said piston in said cylinder does not substantially change the volume of said liquid in said cylinder.

Owing to this arrangement, any drawing-in of air because of substantial change in the volume of liquid present is avoided.

According to a third aspect of the present invention, there is provided dosing apparatus, comprising a piston-and-cylinder device having an upwardly extending longitudinal axis, surface portions of the piston and the cylinder defining an annular chamber in said device and co-axially encircling said piston, a peripheral port of the cylinder opening onto said chamber for supplying a liquid to said chamber, and drive means for reciprocating the piston in the cylinder, wherein the improvement comprises venting means communicating with the upper extremity of said chamber for venting any gaseous matter arriving at the upper extremity of said chamber.

Owing to the venting means, any air introduced into the device is vented away to prevent it from impairing the efficiency of the dosing.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
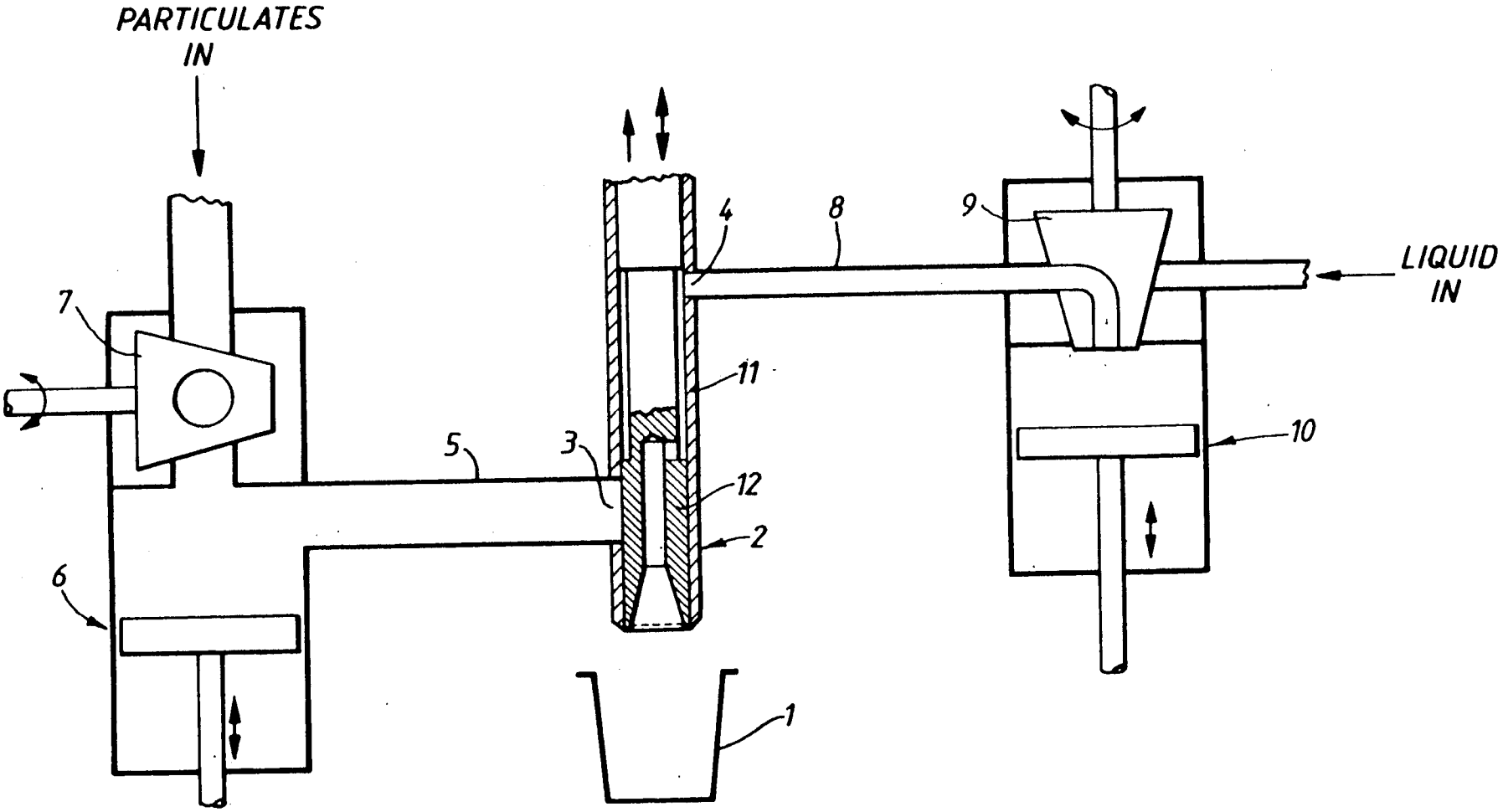
FIG. 1 illustrates diagrammatically and in elevation a dosing apparatus for filling simultaneously or in sequence into a container a thick particulate/liquid mixture and a thin liquid, the apparatus being shown at a "ready to fill" stage of operation.
Figure 2:
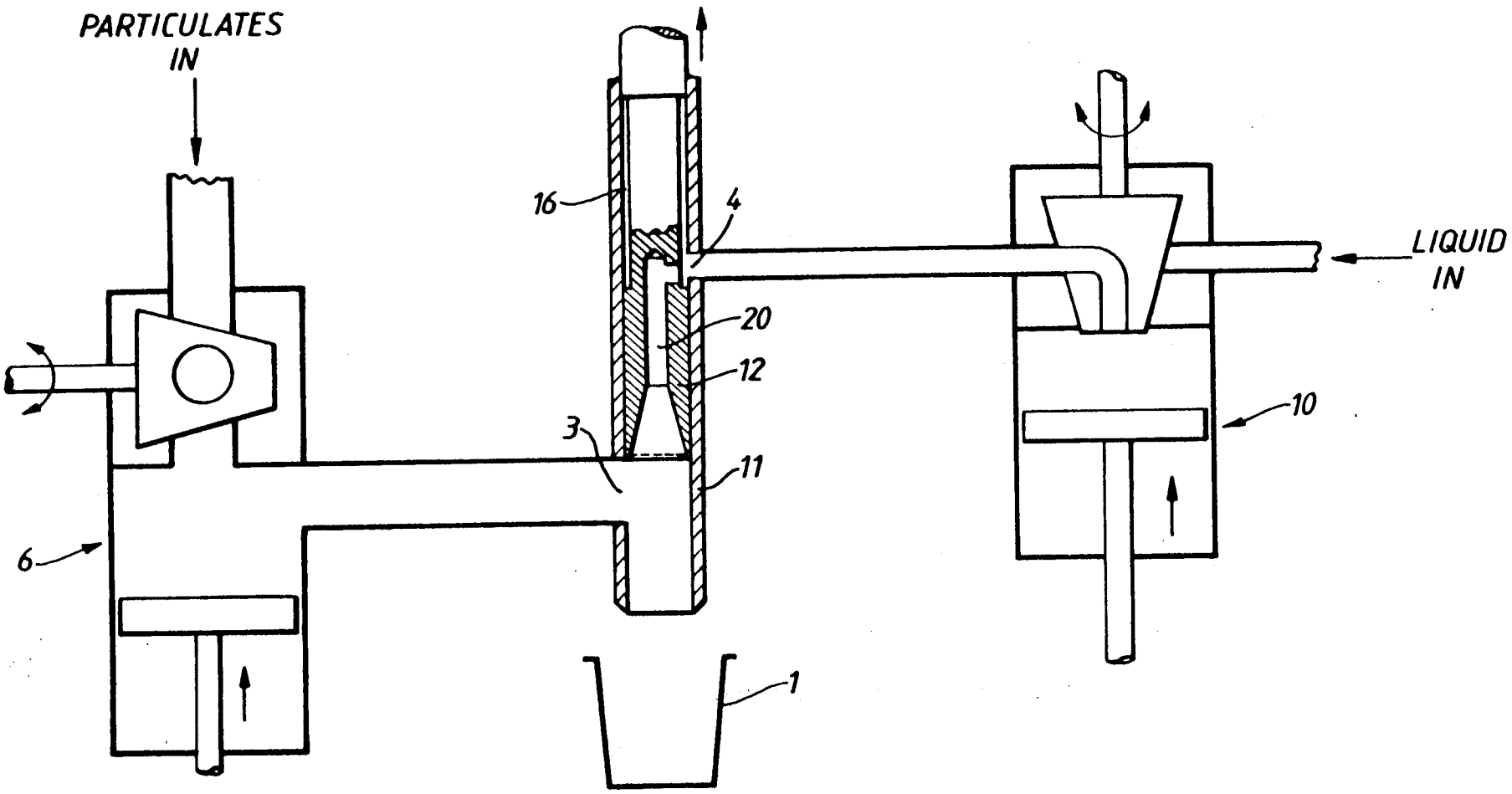
FIG. 2 is a diagram similar to FIG. 1, but with the apparatus in a filling stage of its operation.
Figure 3:
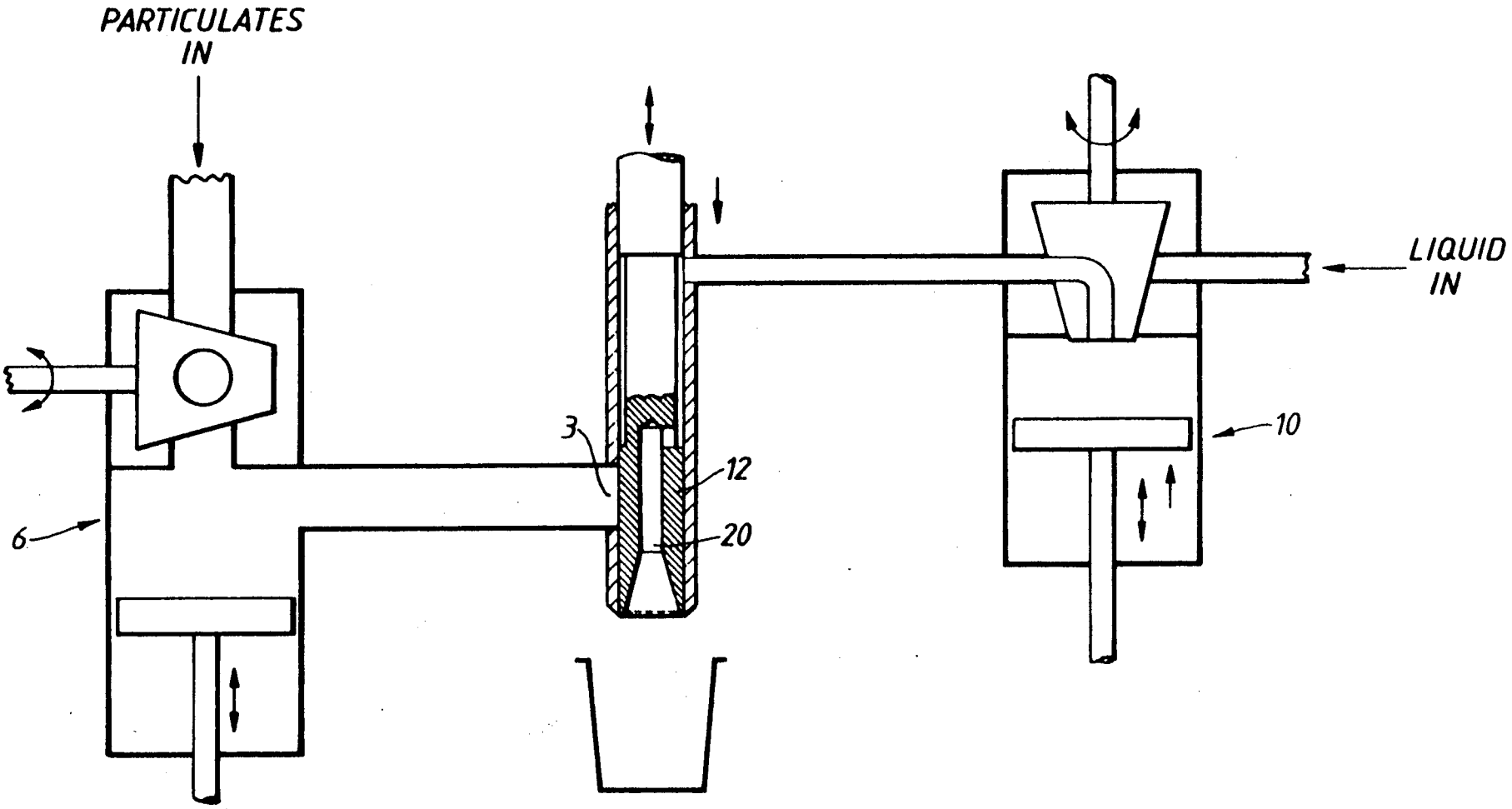
FIG. 3 is a diagram similar to FIG. 1 but of the apparatus in a nozzle-flushing stage of its operation.

Referring to FIGS. 1 to 5, the apparatus is for filling a container 1 with a thick particulate/liquid mixture and with a thin liquid, for example such as disclosed in our co-pending British Patent Application 8631049. The mixture can be a liquid containing vegetable pieces, and the thin liquid can be a water-like sauce.

The mixture and the liquid are filled into the container 1 by a piston-and-cylinder device 2, whereof the internal peripheral surface of the cylinder is formed with a mixture inlet port 3 and a liquid inlet port 4. The port 3 is connected via a conduit 5 to a piston-and-cylinder device 6 which acts as a dosing device for the mixture. The mixture is supplied to the device 6 via a rotary plug valve 7. The port 4 is connected via a conduit 8 and a two-way rotary plug valve 9 to a piston-and-cylinder device 10 serving as a dosing device for the liquid, which is supplied to the device 10 via the valve 9. The device 2 may thus be remote from the devices 6 and 10. Although the valves 7 and 9 are shown as rotary plug valves, they can be of any suitable type.

Figure 5:
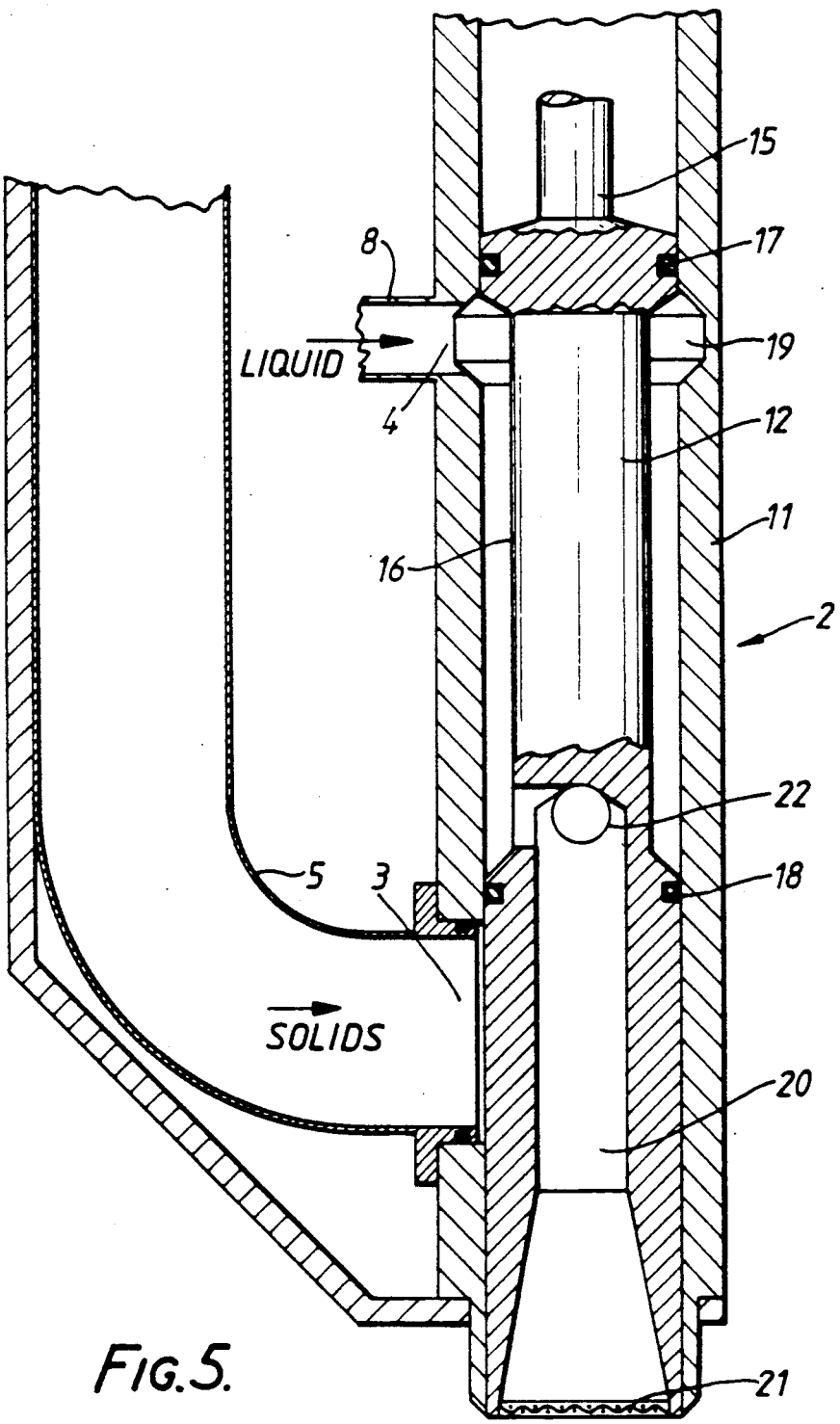
FIG. 5 shows a vertical sectional view through a piston-and-cylinder device of the apparatus.

Referring particularly to FIG. 5, the device 2 includes a vertical cylinder 11 in which a piston 12 is vertically reciprocable by, for example, an hydraulic drive (not shown). The piston 12 is connected to a piston rod 15 and includes an upper part formed coaxially with a peripheral annular channel 16 and provided, immediately above and below the channel 16, with seals 17 and 18. The port 4 opens onto an annular groove 19 (which may be omitted if desired) in the internal peripheral surface of the cylinder 11, which groove is in permanent and constantly full communication with the channel 16. Thus there is always a free path for the liquid flow from the port 4 into the chamber 16. The lower part of the piston 12 is formed coaxially with an internal bore 20 which widens steadily outwardly as it approaches the lower axial end of the piston 12 and is thereby of frustoconical form as it approaches that axial end. The mouth of the conduit 20 at that end is provided with a cover 21 in the form of a gauze disc of which the holes are sufficiently small to prevent the liquid from dripping therefrom under gravity. The diameter of the mouth of the conduit 20 at the cover 21 is, as near as practicable, the full diameter of the nozzle of the cylinder 11. Moreover, the cover 21 is the largest possible, fine-mesh-gauze disc. The upper end of the bore 20 communicates with a diametral intersecting bore 22 linking the channel 16 to the conduit 20.

The operation of the apparatus will now be described, assuming a requirement to fill the container 1 with a solid/liquid mixture and a liquid.

Figure 4:
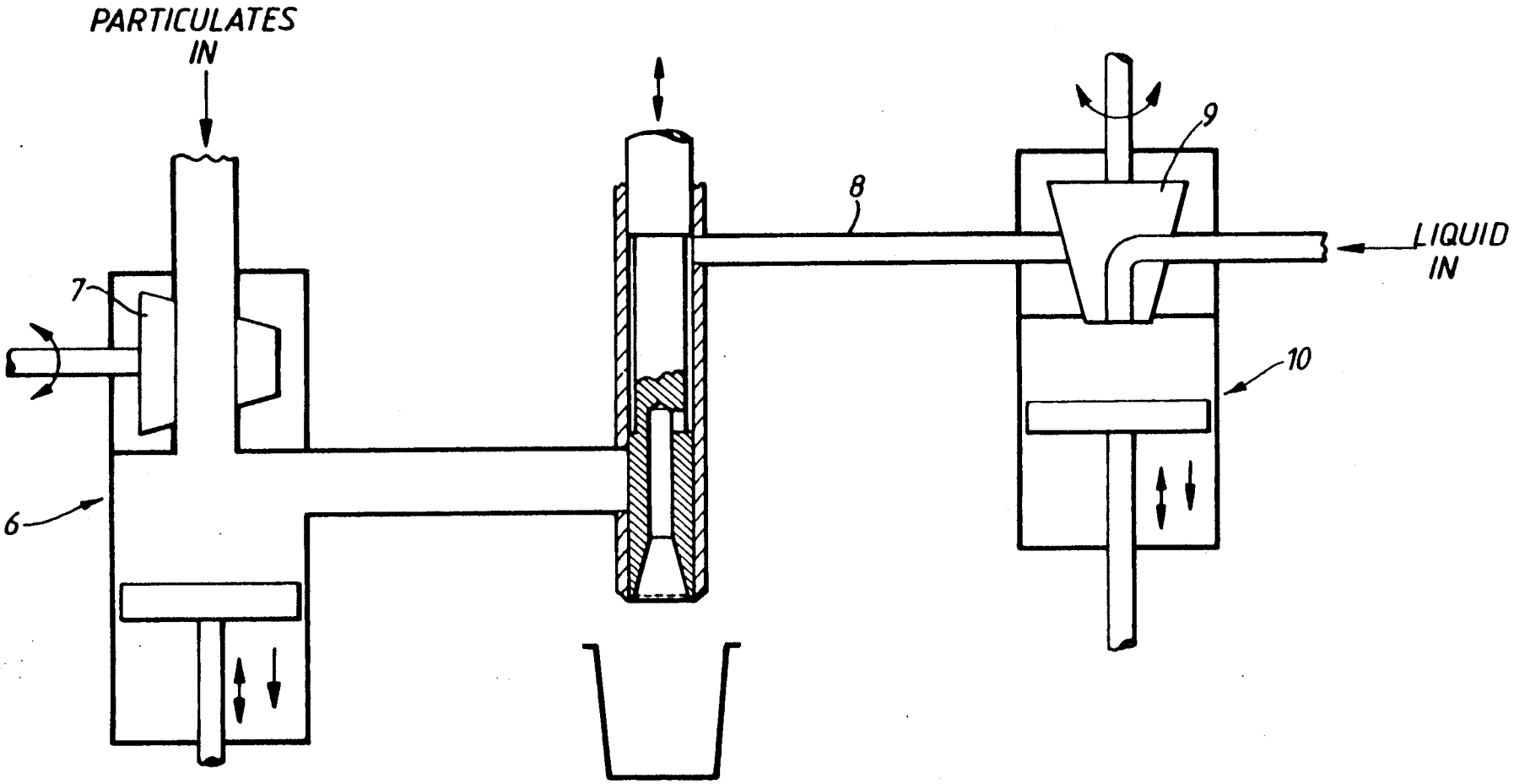
FIG. 4 is a diagram similar to FIG. 1, but with the apparatus in a re-charging stage of its operation.

In the ready-to-fill stage shown in FIG. 1, the port 3 is maintained closed by the peripheral surface of the piston 12, the dosing devices 6 and 10 are charged, each to an adjustable, set extent, the valve 7 is closed, and the valve 9 is closed against supply of liquid to the device 10 but open for supply of liquid from the device 10 to the conduit 8. Firstly, the piston 12 is lifted to its open position shown in FIG. 2, in which position the lower axial end of the piston 12 is clear of and faces towards the port 3. The piston of the device 6 can now be moved inwards to discharge the mixture through the port 3 and the nozzle provided by the lower end of the cylinder 11. The piston of the device 10 may also be moved inwards to discharge the liquid via the port 4, the channel 16, the conduit 20 and that nozzle into the container 1. When the desired dose of mixture has been discharged into the container 1, the piston of the device 6 stops moving and the piston 12 is lowered into the closed position shown in FIG. 3, so that the port 3 is closed and, not only does the rim of the mouth of the piston 12 scavenge the internal peripheral surface of the cylinder 11, but also the liquid continuing for a short time to be supplied by the device 10 and thus continuing to debouch from the conduit 20 washes the cover 21 and the internal peripheral surface of the cylinder 11 below the cover 21. In the closed position of the piston 12, the rim of the mouth of the conduit 20 has arrived at the rim of the nozzle of the cylinder 11, as seen in FIG. 5. In order to recharge the dosing devices 6 and 10, as shown in FIG. 4, the valve 7 is opened and the piston of the device 6 is moved outwards to draw the mixture into the device 6; whilst the valve 9 is turned to close the device 10 off from communication with the conduit 8 and the piston of the device 10 is moved outwards to draw in the liquid through the valve 9 from the liquid supply. The apparatus is then brought to the stage shown in FIG. 1 and the cycle of operation recommences.

In setting up the apparatus ready to fill, first of all air is totally flushed out of the product supply pipes and the channel 16 and the conduit 20 are completely filled with liquid. During liquid filling, the conduit 20 and its supply arrangement are kept totally full of liquid. The system is completely closed except for the cover 21 which causes the liquid to be held in the conduit 20 under the surface tension effect of the liquid. Thus, the liquid can only pass through the cover 21 as more liquid is fed in from the supply. Therefore, the system provides a very clean, positive, cut-off action at the end of each fill. Moreover, solids do not penetrate the cover 21 and any adhering to the outside of the cover 21 are immediately washed off by the liquid fill.

The design of the device 2 is such that, as the piston 12 rises and falls there is no change in volume within the liquid supply path in the apparatus. In particular, the volume of the liquid in the cylinder 11 remains unchanged.

Figure 6:
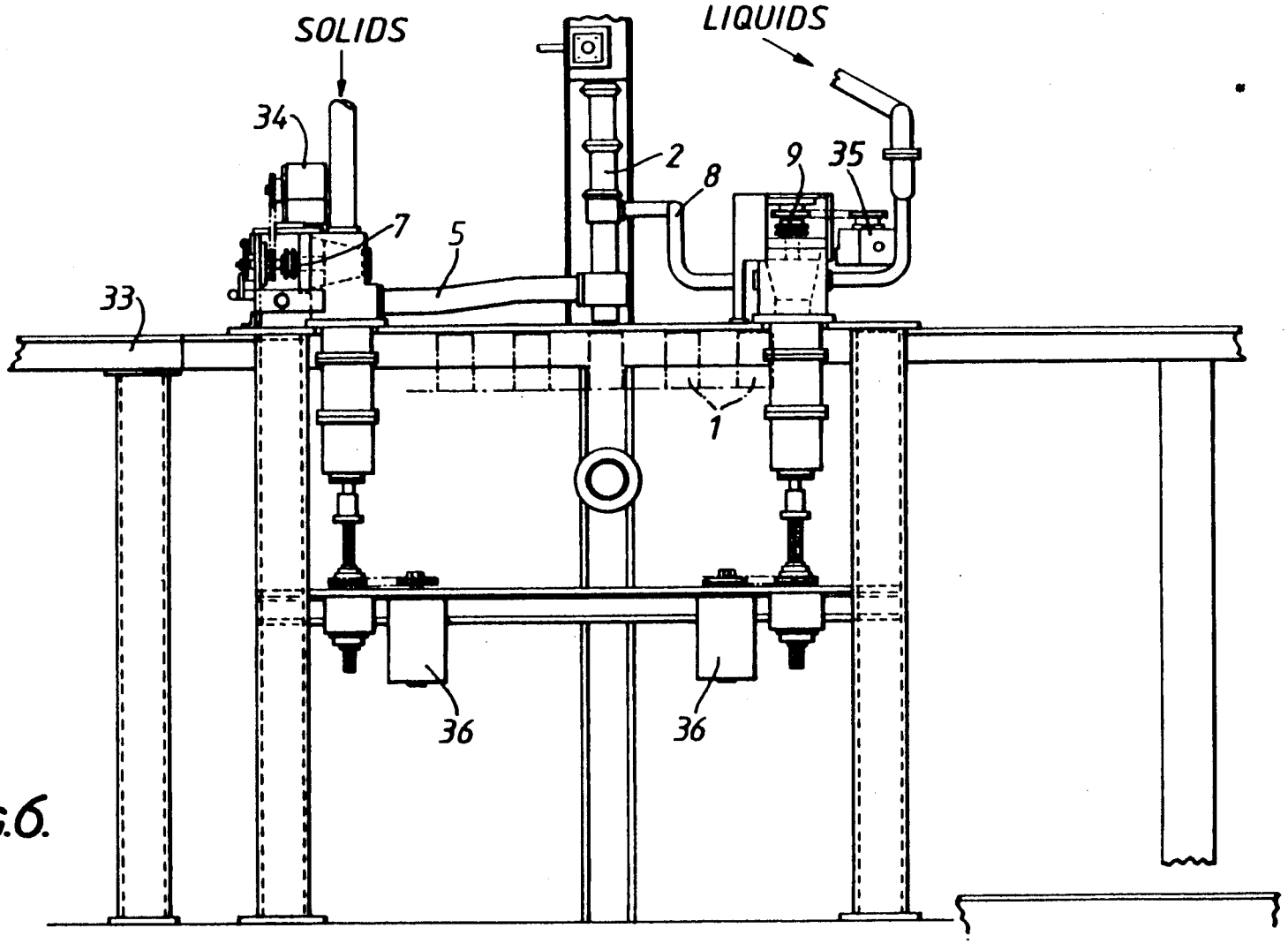
FIG. 6 shows an elevation of the apparatus.
Figure 7:
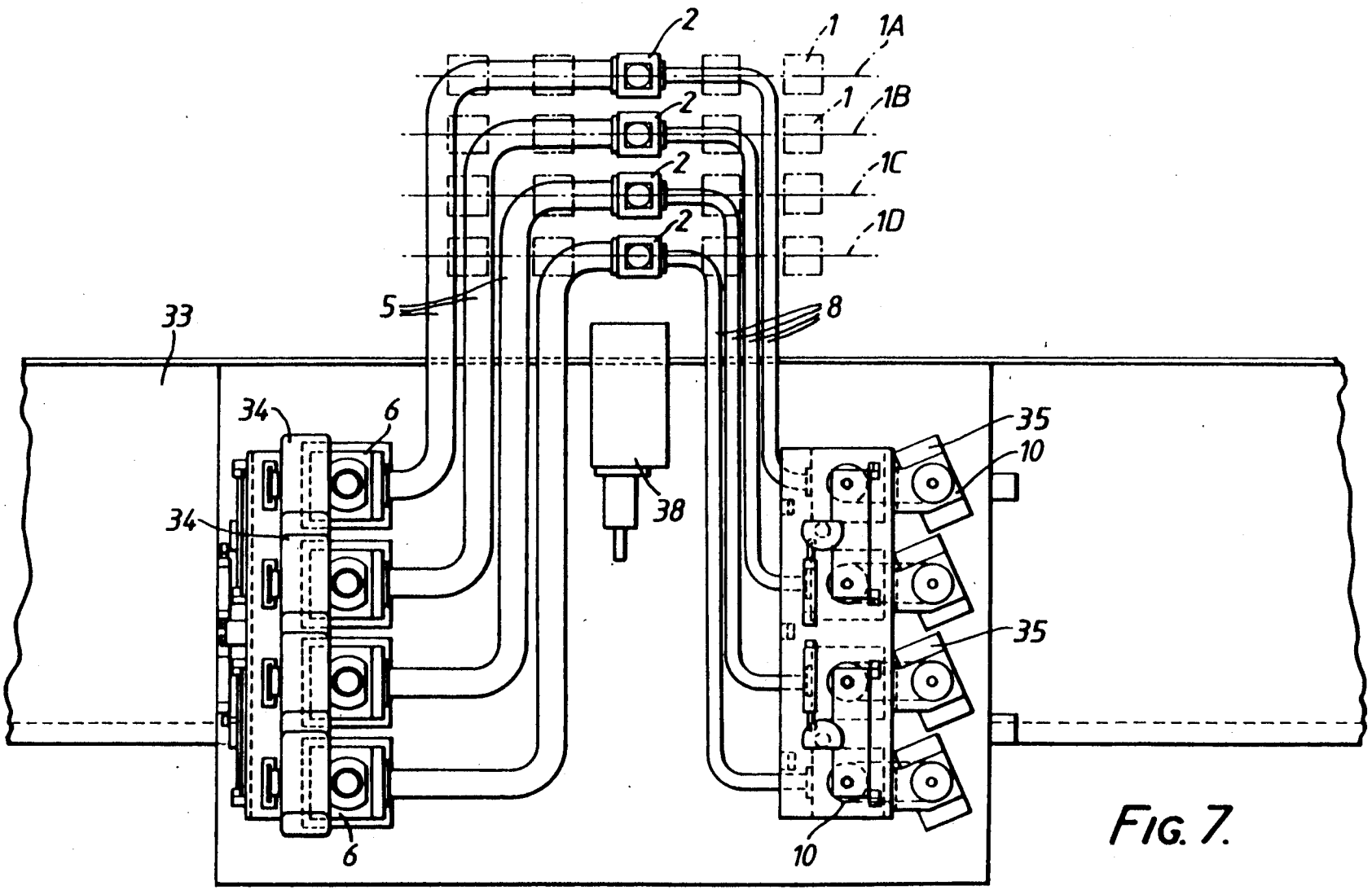
FIG. 7 shows a plan view of apparatus.

The apparatus shown in detail in FIGS. 6 and 7 serves to fill four parallel lines 1A to 1D of containers 1 as they are advanced below four devices 2, the latter being connected by four pipes 5 to respective devices 6 and by four pipes 8 to respective devices 10. The devices 6 and 10 are mounted in a supporting frame 33. The four rotary plug valves 7 are driven by respective motors 34, whilst the four rotary plug valves 9 are driven by respective motors 35. The pistons of the devices 6 and 10 are driven by motors 36 and 37, respectively. A drive 38 operates the devices 2.

Figure 8:
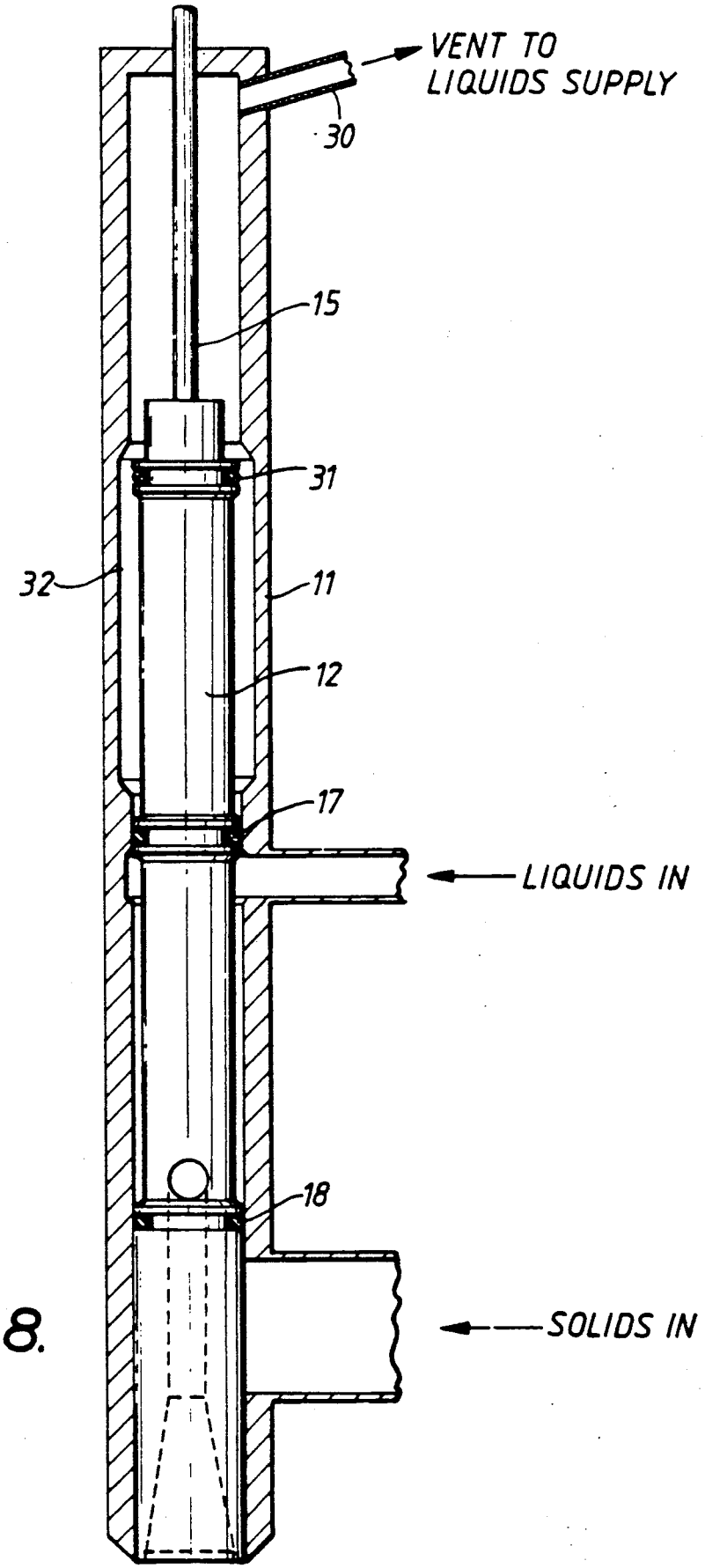
FIG. 8 shows a vertical section through a piston-and-cylinder device of a modified version of the apparatus.

The device 2 shown in FIG. 8 differs from the device 2 described with reference to FIGS. 1 to 5 in having a vent tube 30 leading to the liquid supply, the piston 12 extended upwards to carry a seal 31 spaced above the seal 17, and the cylinder 11 provided internally and co-axially with an annular recess 32. The height of the recess 32 is slightly less than the spacing between the seals 17 and 31. As the piston 12 reciprocates, the volume of thin liquid in the cylinder 11 below the seal 31 remains constant.

This arrangement provides for simple automatic air venting, whereby any air entering the liquid section of the device 2 above the cover 21 is vented to the liquids supply tank (not shown). It is important that air is not allowed to accumulate in the liquid section of the device 2. The presence of even quite small amounts of air could adversely affect the cleanliness of fill cut-off. The venting is of particular benefit when filling small amounts of liquid, where there is insufficient flow-through to clear any air from the device 2.

In operation, as the piston 12 moves, any air present, rising to the top, is allowed to pass first the seal 17 and then the seal 31, and thus finally freed to vent to the liquid supply tank.

The apparatus is particularly applicable to sophisticated UHT products and is designed to fill cleanly a combination of particulate and liquid products. It allows full control of the proportions and quantities of each product phase and also of the rates of fill and timings throughout the filling cycle to be provided. The apparatus is particularly suitable for incorporation in a fully aseptic system.

The apparatus described with reference to the drawings is very versatile, particularly as regards the rates of fill of the mixture and of the liquid, as regards the proportions of mixture to liquid, and as regards the timing of the filling of the liquid in relation to the filling of the mixture, all of which can be adjusted by appropriate timing and speed-adjustment of the movements of the pistons of the devices 2, 6 and 10, in particular. Thus, it is not necessary to discharge the liquid at the same time as the mixture. It is however highly desirable at least to finish the fill with a small amount of the liquid to clean the nozzle.

We claim:

1. Dosing apparatus comprising a piston-and-cylinder device, a first peripheral port of the cylinder which port is swept by the piston as the piston moves between an open position in which said peripheral port is open and in which an axial end of said piston faces towards said port and a closed position in which said piston closes said peripheral port, means for supplying a flowable material to said port, drive means for reciprocating the piston in the cylinder, and a permanently fully open second peripheral port of said cylinder situated after the first port in the direction in which said piston moves in moving from said closed position to said open position for supplying to said cylinder a liquid, said cylinder having an outlet for both said flowable material and said liquid, said outlet communicating with both said first peripheral port and said second peripheral port when said piston is in its open position, and the arrangement being such that the reciprocation of said piston in said cylinder does not substantially change the volume of said liquid in said cylinder.

2. Dosing apparatus, comprising a piston-and-cylinder device having an upwardly extending longitudinal axis, surface portions of the piston and the cylinder defining a lower annular chamber in said device which chamber co-axially encircles said piston, a peripheral port of the cylinder opening onto said chamber for supplying a liquid to said chamber, drive means for reciprocating the piston in the cylinder, first annular sliding seal means between said piston and said cylinder at the upper end of said chamber, other surface portions of the piston and the cylinder defining an upper annular chamber in said device which upper annular chamber co-axially encircles said piston at a location above the first seal means, second annular sliding seal means between said piston and said cylinder at the other end of said upper annular chamber, and venting means communicating with the upper extremity of said upper annular chamber for venting any gaseous matter arriving at the upper extremity of said upper annular chamber, said cylinder having an outlet for said flowable material and said liquid, and the reciprocation of said piston in said cylinder displacing the piston between one position in which said upper annular chamber is in communication with said venting means past the second seal means and the lower annular chamber is prevented by said first seal means from communicating with said upper annular chamber and another position in which said upper annular chamber is prevented by said second seal means from communicating with said venting means and said lower annular chamber is in communication with said upper annular chamber past said first seal means.

3. Dosing apparatus comprising a piston-and-cylinder device, the piston having a cylindrical external peripheral surface and an axial end, and the cylinder having a cylindrical internal peripheral surface and a peripheral port debouching at said cylindrical internal peripheral surface, said peripheral port being swept by the piston as the piston moves between an open position in which said peripheral port is open and in which said axial end of said piston faces towards said port, and a closed position in which said cylindrical external peripheral surface closes said port and extends face-to-face with said cylindrical internal peripheral surface in both longitudinal directions of said cylinder from said peripheral port, drive means for reciprocating the piston in the cylinder, means for supplying a flowable material to said port, a conduit extending in said piston and debouching longitudinally of said cylinder at said axial end in the form of a mouth, means for supplying a liquid to said conduit, a permanently fully open second peripheral port of said cylinder connected to said means for supplying a liquid and situated after the first-mentioned port in the direction in which the piston moves in moving from said closed position to said open position, said means for supplying a liquid communicating with said mouth by way of said second peripheral port and thence said conduit for supplying to said mouth said liquid for mixing with the flowable material, and sealing means between said piston and said cylinder and situated after said second peripheral port in the last-mentioned direction, said cylinder having an outlet for said flowable material and said liquid, and the arrangement being such that the reciprocation of said piston in said cylinder does not substantially change the volume of said liquid in said cylinder after said sealing means in the direction in which the piston moves in moving from said open position to said closed position.

4. Dosing apparatus comprising a piston-and-cylinder device, the piston having a cylindrical external peripheral surface and an axial end, and the cylinder having a cylindrical internal peripheral surface and a peripheral port debouching at said cylindrical internal peripheral surface, said peripheral port being swept by the piston as the piston moves between an open position in which said peripheral port is open and in which said axial end of said piston faces towards said port, and a closed position in which said cylindrical external peripheral surface closes said port and extends face-to-face with said cylindrical internal peripheral surface in both longitudinal directions of said cylinder from said peripheral port, drive means for reciprocating the piston in the cylinder, means for supplying a flowable material to said port, a conduit extending in said piston and debouching longitudinally of said cylinder at said axial end in the form of a mouth, and means for supplying a liquid to the interior of said cylinder and thence to said conduit, and a liquid inlet port of said cylinder by way of which said means for supplying a liquid supplies said liquid to said conduit, said cylinder having an outlet for said flowable material and said liquid, extending upwardly in the direction in which the piston moves in moving from said closed position to said open position and being provided at the upper extremity of its interior with a venting conduit communicating with said interior for venting air from said interior.

* * * * *